US008319575B2

(12) United States Patent
Hasegawa

(10) Patent No.: US 8,319,575 B2
(45) **Date of Patent: *Nov. 27, 2012**

(54) MAGNETIC RESONANCE TYPE ISOLATOR

(75) Inventor: Takashi Hasegawa, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/222,006

(22) Filed: Aug. 31, 2011

(65) Prior Publication Data

US 2012/0056691 A1 Mar. 8, 2012

(30) Foreign Application Priority Data

Sep. 3, 2010 (JP) ..... 2010-197354

(51) Int. Cl.
*H01P 1/36* (2006.01)
*H01P 1/387* (2006.01)

(52) U.S. Cl. ..... 333/24.2; 333/1.1

(58) Field of Classification Search ..... 333/1.1, 333/24.2

See application file for complete search history.

(56) References Cited

FOREIGN PATENT DOCUMENTS

JP 63-260201 A 10/1988
JP 2001-326504 A 11/2001

OTHER PUBLICATIONS

Hasegawa; "Magnetic Resonance Type Isolator"; U.S. Appl. No. 13/222,004, filed Aug. 31, 2011.

*Primary Examiner* — Stephen Jones
(74) *Attorney, Agent, or Firm* — Keating & Bennett, LLP

(57) ABSTRACT

A magnetic resonance type isolator includes a ferrite; a connection conductor that is arranged on the ferrite and includes first, second and third ports; a permanent magnet that applies a direct current magnetic field to the ferrite; a capacitor (or an inductor) that defines a first reactance element; and a capacitor (or an inductor) that defines a second reactance element. A main line arranged between the first port and the second port of the connection conductor does not resonate, an end portion of a sub-line that branches off from the main line serves as the third port, and a wave reflected from the sub-line is modulated so that its phase is shifted by 90° or about 90° at an intersection of the connection conductor. One of the capacitors is connected to the third port and the other capacitor is connected between the first port and the second port.

11 Claims, 17 Drawing Sheets

MAGNETIC RESONANCE TYPE ISOLATOR

BACKGROUND OF THE INVENTION

1. Field of the Invention

The present invention relates to magnetic resonance type isolators and in particular, relates to magnetic resonance type isolators that are, for example, used in a microwave frequency band.

2. Description of the Related Art

Typically, isolators have a characteristic of only transmitting signals in a specific direction and not transmitting signals in the opposite direction. Isolators are included in transmission circuit units of mobile communication devices such as cellular phones. Known examples of magnetic resonance type isolators include those described in Japanese Unexamined Patent Application Publication Nos. 63-260201 and 2001-326504. Magnetic resonance type isolators utilize a phenomenon that occurs as follows. When high-frequency currents that have the same amplitude but differ in phase by about ¼ of a wavelength flow through two orthogonal lines (having four ports), a magnetic field (circularly polarized wave) is generated at the intersection of the two lines, and the circulating direction of the circularly polarized wave is reversed in accordance with the progression directions of the electromagnetic waves of the two lines. That is, a ferrite is arranged at an intersection of two lines and a static magnetic field is applied, which is necessary for magnetic resonance, by using a permanent magnet, and accordingly a positively circularly polarized wave or a negatively circularly polarized wave is generated by a wave being reflected from a sub-line in accordance with the progression direction of an electromagnetic wave progressing along a main line. If a positively circularly polarized wave is generated, a signal is absorbed by the magnetic resonance of the ferrite, and if a negatively circularly polarized wave is generated, magnetic resonance does not occur and the signal passes through. A reactance element, which causes a signal to be reflected, is connected to an end portion of the sub-line.

However, to date, magnetic resonance type isolators have had a main line having a length of about ¼ of a wavelength so that the main line would resonate and have included two reactance elements, and consequently have had a large size of, for example, 20 mm by 20 mm for a frequency of about 2 GHz. This is not compatible with the current situation in which mobile communication devices have been becoming increasingly smaller in recent years and the density with which components thereof are mounted has been becoming increasingly high. Furthermore, it is necessary to adjust the impedances of the input and output, but magnetic resonance type isolators of the related art have been unable to satisfy this requirement and it has been necessary to provide such isolators with a separate impedance conversion device as a separate component.

SUMMARY OF THE INVENTION

Accordingly, preferred embodiments of the present invention provide a magnetic resonance type isolator that has a significantly reduced size and is capable of adjusting the input and output impedances.

A magnetic resonance type isolator according to a first preferred embodiment includes a ferrite; a connection conductor that is arranged on the ferrite and includes a first port, a second port and a third port; and a permanent magnet that applies a direct current magnetic field to the ferrite. A main line arranged between the first port and the second port of the connection conductor does not resonate, an end portion of a sub-line that branches off from the main line serves as the third port, a first reactance element is connected to the third port and the first reactance element is connected to the ground. A second reactance element is connected between the first port and the second port.

In the magnetic resonance type isolator according to the first preferred embodiment, a wave reflected from the sub-line to which the first reactance element is connected is modulated such that its phase is shifted by 90° or about 90° at the intersection of the connection conductor with respect to waves incident from the first and second ports. Thus, a positively or negatively circularly polarized wave is generated at the intersection. A signal is absorbed or is allowed to pass in accordance with generation of a positively or negatively circularly polarized wave as in the related art. In the magnetic resonance type isolator, the main line does not resonate and therefore it is possible to reduce the length of the main line to about ¼ or less of the wavelength and since the magnetic resonance type isolator includes three ports, it is sufficient to use only a single reactance element. Thus, a magnetic resonance type isolator can be realized that is very compact and has a low impedance. Moreover, it is possible to adjust the input and output impedances via the second reactance element connected between the first port and the second port and thus it is not necessarily required to add an impedance conversion device as a separate component and such a component of an impedance conversion circuit can be omitted. Furthermore, the operation frequency can be adjusted via the second reactance element.

A magnetic resonance type isolator according to a second preferred embodiment includes a ferrite including a first main surface and a second main surface that oppose each other; a connection conductor that is arranged on the first main surface of the ferrite and includes a first port, a second port and a third port; and a permanent magnet that applies a direct current magnetic field to the ferrite. A main line arranged between the first port and the second port of the connection conductor does not resonate, a sub-line that branches off from the main line serves as an opposing conductor that extends in a direction perpendicular or substantially perpendicular to the main line onto the second main surface, an end portion of the opposing conductor serves as the third port, a first reactance element is connected to the third port and the first reactance element is connected to the ground. A second reactance element is connected between the first port and the second port.

The operational principle and the operational advantages of the magnetic resonance type isolator according to the second preferred embodiment are the same as those of the magnetic resonance type isolator according to the first preferred embodiment. In the magnetic resonance type isolator according to the second preferred embodiment, the opposing conductor that extends in a direction perpendicular or substantially perpendicular to the main line onto the second main surface of the ferrite is arranged so as to extend from the sub-line, and therefore a high frequency magnetic field is confined to the ferrite due to the opposing conductor, leakage of the magnetic flux is small and the insertion loss is improved.

A magnetic resonance type isolator according to a third preferred embodiment includes a ferrite including a first main surface and a second main surface that oppose each other; a connection conductor that is arranged on the first main surface of the ferrite and includes a first port, a second port and a third port; a permanent magnet that applies a direct current magnetic field to the ferrite; and a mounting substrate. A main line arranged between the first port and the second port of the connection conductor does not resonate, an end portion of a sub-line that branches off from the main line serves as the third port, a first reactance element is connected to the third port and the first reactance element is connected to the ground. A second reactance element is connected between the first port and the second port. The ferrite is sandwiched between a pair of permanent magnets, which respectively oppose the first and second main surfaces of the ferrite, and the ferrite is mounted on the mounting substrate such that the first and second main surfaces thereof are perpendicular or substantially perpendicular to a surface of the mounting substrate.

The operational principle and the operational advantages of the magnetic resonance type isolator according to the third preferred embodiment are the same as those of the magnetic resonance type isolator according to the first preferred embodiment. In the magnetic resonance type isolator according to the third preferred embodiment, the ferrite is vertically arranged on the mounting substrate in a state of being sandwiched between the pair of permanent magnets, which oppose the first and second main surfaces of the ferrite. Thus, the configuration of the circuit to which the first and/or second reactance elements have been added can be simplified.

According to various preferred embodiments of the present invention, a magnetic resonance type isolator achieves a significantly reduced size and is capable of adjusting input and output impedances.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereafter, preferred embodiments of a magnetic resonance type isolator according to the present invention will be described with reference to the accompanying drawings. In each of the drawings, like components and portions will be denoted by the same symbols and repeated description thereof will be avoided. Furthermore, in each of the drawings, portions that are shaded with diagonal lines indicate conductors.

First Preferred Embodiment

A magnetic resonance type isolator 1A according to a first preferred embodiment will be described hereafter with reference to FIGS. 1 to 5D.

Figure 1:
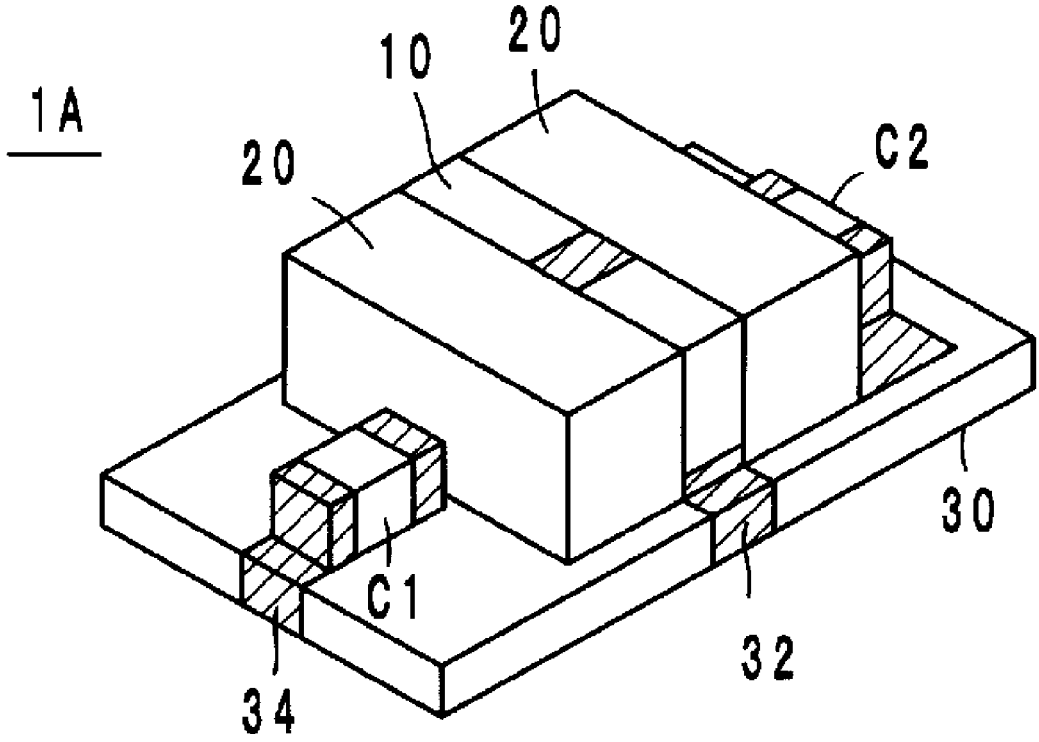
FIG. 1 is a perspective view illustrating a magnetic resonance type isolator according to a first preferred embodiment of the present invention.
Figure 2:
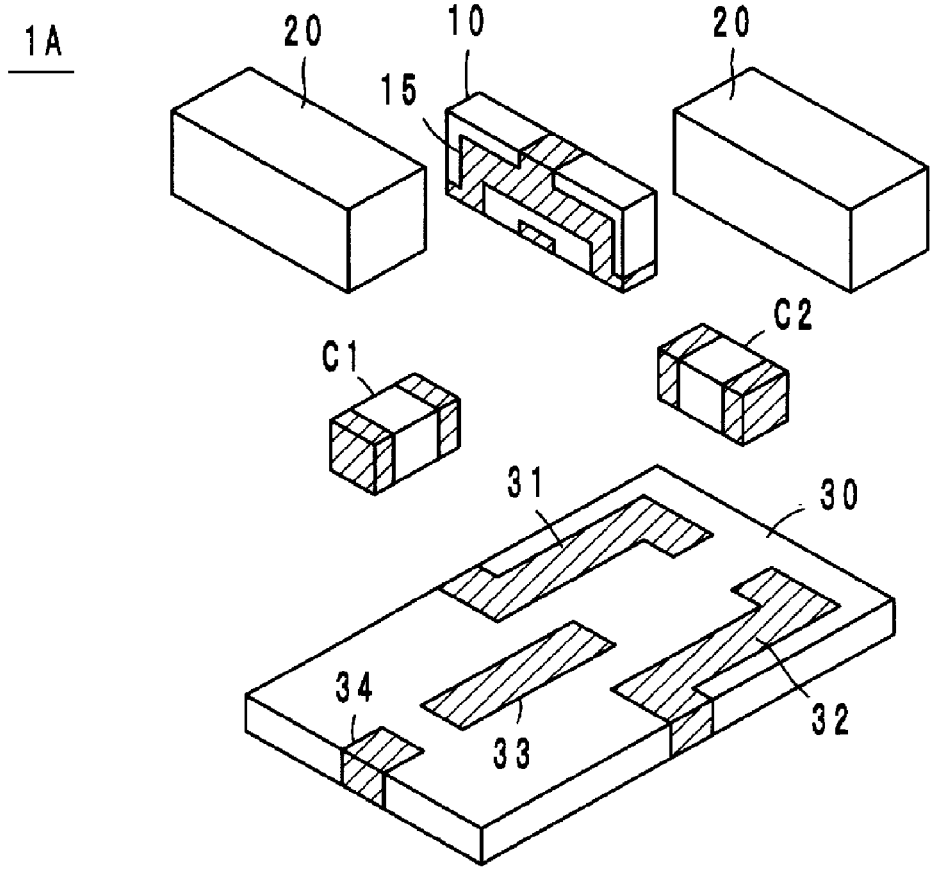
FIG. 2 is an exploded perspective view illustrating the magnetic resonance type isolator according to the first preferred embodiment of the present invention.

As illustrated in FIGS. 1 and 2, the magnetic resonance type isolator 1A according to the first preferred embodiment includes a ferrite 10, a connection conductor 15 including three ports P1, P2 and P3 and arranged on a first main surface 11 of the ferrite 10, a pair of permanent magnets 20 that apply a direct current magnetic field to the ferrite 10, a capacitor C1 that defines a first reactance element, a capacitor C2 that defines a second reactance element, and a mounting substrate 30.

Figure 3A:
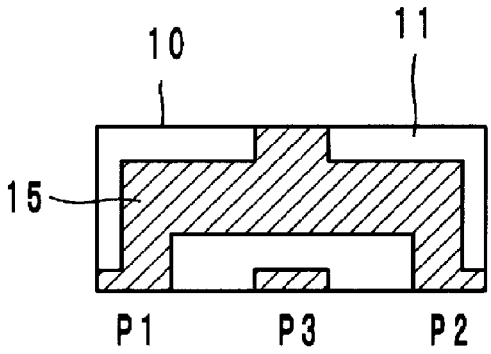
FIG. 3A and FIG. 3B are respectively a top surface view and a bottom surface view of a ferrite of the magnetic resonance type isolator according to the first preferred embodiment of the present invention.
Figure 3B:
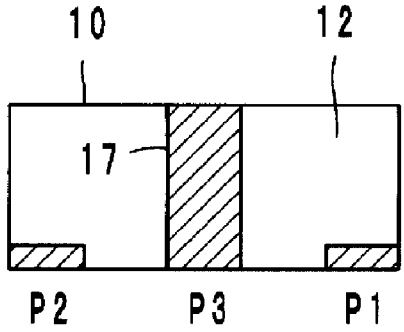

The connection conductor 15 preferably is a thin film formed by, for example, deposition of a conductive metal or is a thick film formed by applying and baking a conductive paste. As illustrated in FIGS. 3A and 3B, a main line, which is arranged between the first port P1 and the second port P2 that face each other along a straight line, among the three ports P1, P2 and P3 of the connection conductor 15, is given a line length of about ¼ of the wavelength or less at which the main line does not resonate. On the first main surface 11, a sub-line that branches off from the main line of the connection conductor 15 extends in a direction that is perpendicular or substantially perpendicular to the main line onto a second surface 12 from the top surface of the ferrite 10 and serves as an opposing conductor 17, and an end portion of the opposing conductor 17 wraps around onto the first main surface 11 and serves as the third port P3. Here, the term "main line" refers to a conductor that extends between the first port P1 and the second port P2 and the term "sub-line" refers to a conductor that branches off from a central portion of the main line and extends to the third port P3.

In addition, the ferrite 10 is sandwiched between the pair of permanent magnets 20, which respectively oppose the first and second main surfaces 11 and 12 of the ferrite 10, and the ferrite 10 is mounted on the mounting substrate 30 in an orientation in which the first and second main surfaces 11 and 12 thereof are perpendicular or substantially perpendicular to the surface of the mounting substrate 30 (that is, arranged vertically).

An input terminal electrode 31, an output terminal electrode 32, a relay terminal electrode 33 and a ground terminal electrode 34 are provided on the mounting substrate 30. When the ferrite 10, which has been equipped with the permanent magnets 20, is mounted on the mounting substrate 30, one end of the main line (first port P1) is connected to the input terminal electrode 31, the other end of the main line (second port P2) is connected to the output terminal electrode 32, and an end portion of the sub-line (third port P3) is connected to the relay terminal electrode 33. One end of the capacitor C1 is connected to the relay terminal electrode 33 (third port P3) and the other end of the capacitor C1 is connected to the ground terminal electrode 34. One end of the capacitor C2 is connected to the input terminal electrode 31 (first port P1) and the other end of the capacitor C2 is connected to the output terminal electrode 32 (second port P2).

Figure 4:
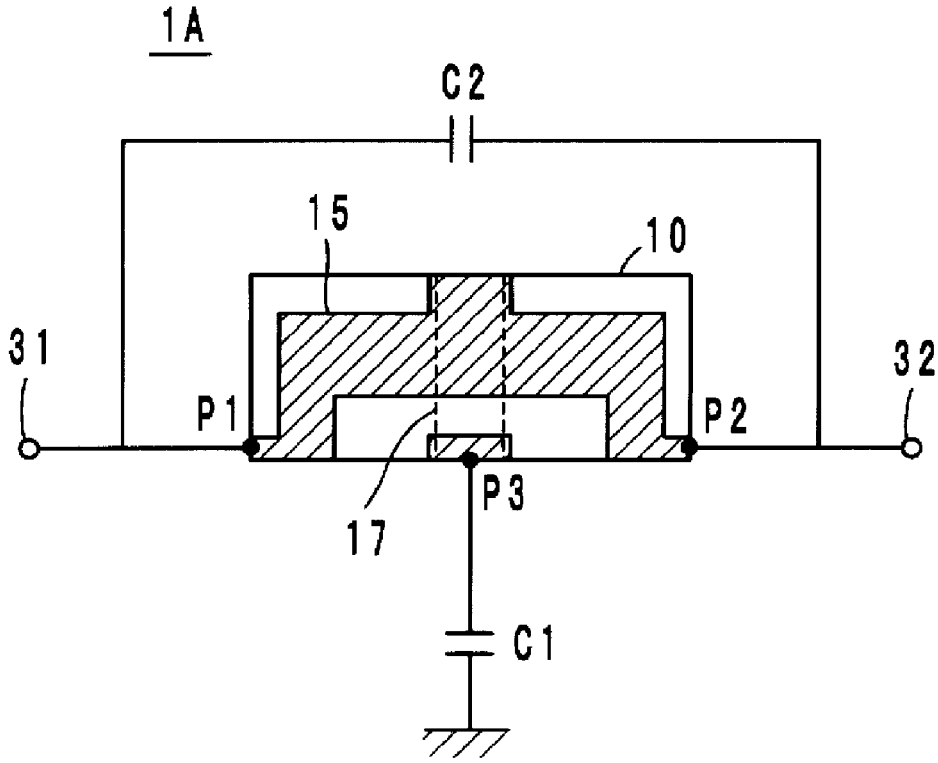
FIG. 4 is an equivalent circuit diagram of the magnetic resonance type isolator according to the first preferred embodiment of the present invention.
Figure 5A:
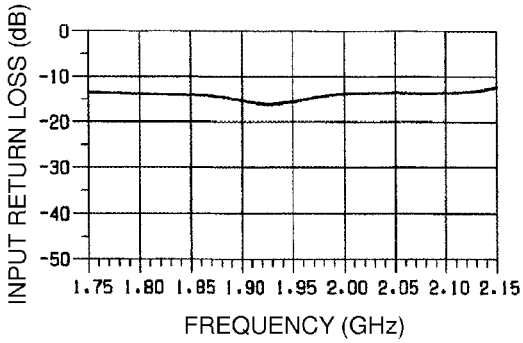
FIGS. 5A to 5D are graphs illustrating characteristics of the magnetic resonance type isolator according to the first preferred embodiment of the present invention.
Figure 5B:
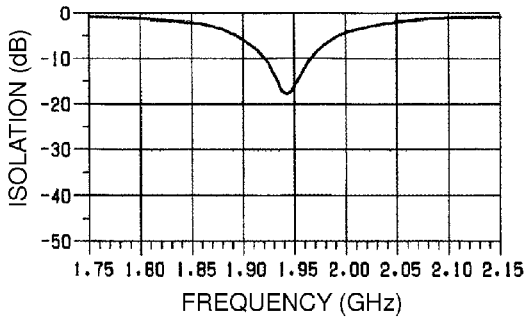
Figure 5C:
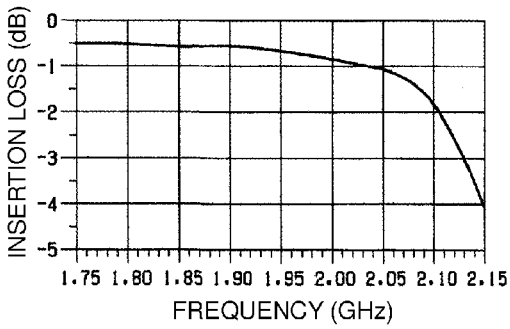
Figure 5D:
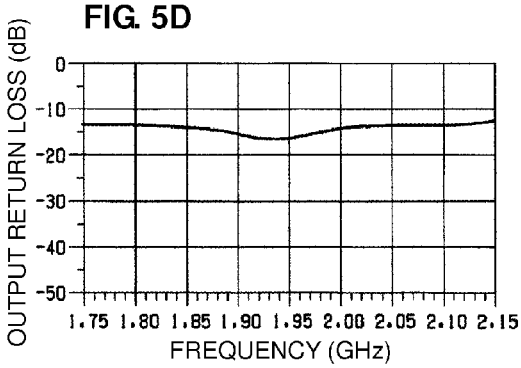
Figure 6:
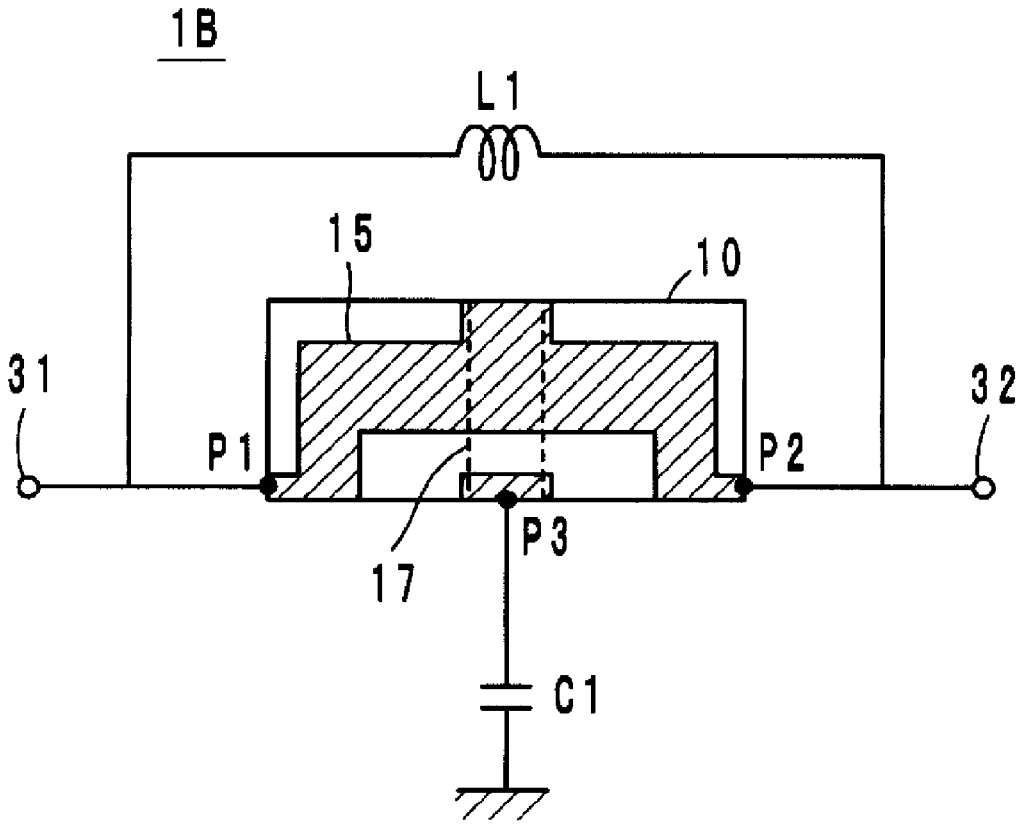
FIG. 6 is an equivalent circuit diagram of a magnetic resonance type isolator according to a second preferred embodiment of the present invention.
Figure 7A:
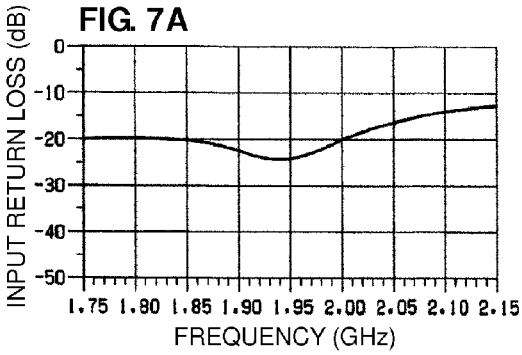
FIGS. 7A to 7D are graphs illustrating characteristics of the magnetic resonance type isolator according to the second preferred embodiment of the present invention.
Figure 7B:
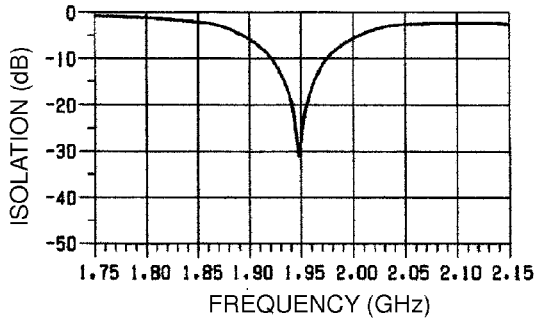
Figure 7C:
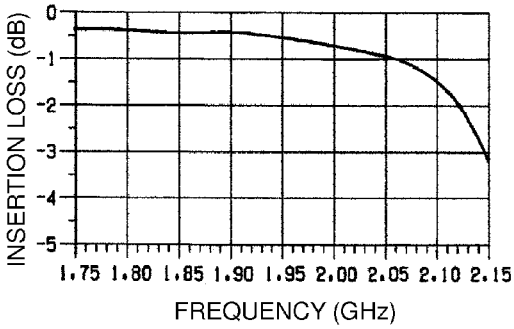
Figure 7D:
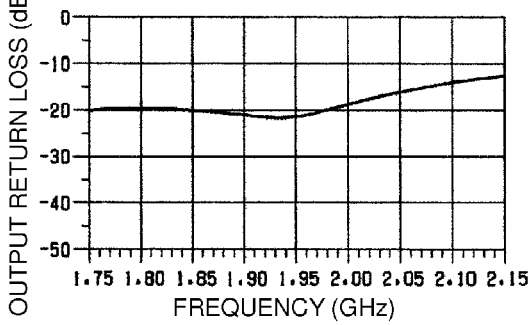
Figure 8:
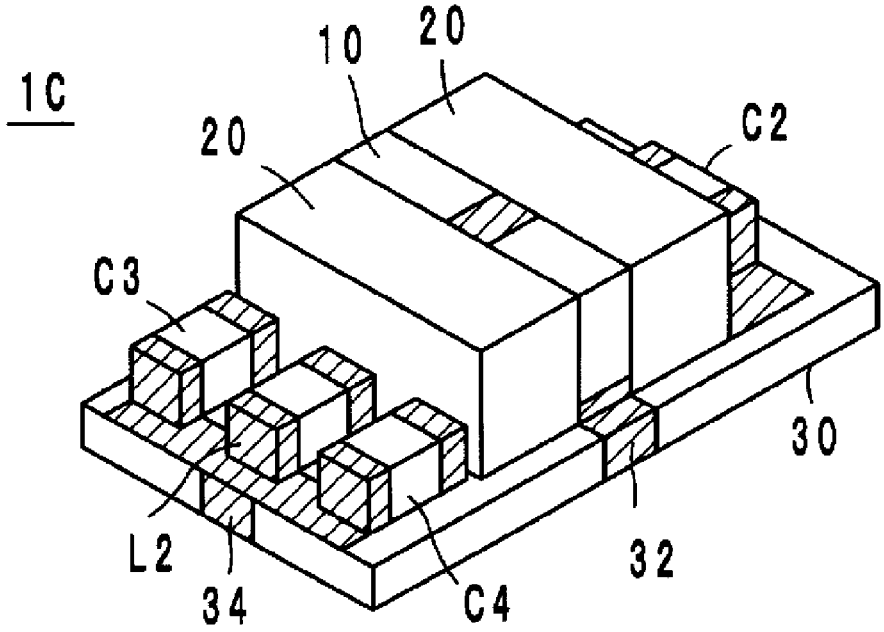
FIG. 8 is a perspective view illustrating a magnetic resonance type isolator according to a third preferred embodiment of the present invention.

An equivalent circuit is illustrated in FIG. 4. In the magnetic resonance type isolator 1A having the above-described configuration, a wave reflected from the sub-line to which the capacitor C1 is connected is modulated such that the phase thereof is shifted by 90° or about 90° at an intersection of the connection conductor 15 with respect to a wave incident from the first port P1 or the second port P2. In more detail, a wave incident from the first port P1 is transmitted through to the second port P2 because a negatively circularly polarized wave is generated at the intersection due to the wave reflected from the sub-line and as a result magnetic resonance is not generated. On the other hand, a wave incident from the second port P2 is absorbed by magnetic resonance due to a positively circularly polarized wave being generated at the intersection as a result of the wave reflected from the sub-line.

The input return loss, isolation, insertion loss and output return loss of the magnetic resonance type isolator 1A according to the first preferred embodiment are illustrated in FIGS. 5A, 5B, 5C and 5D, respectively. The capacitance of the capacitor C1 is preferably about 2.0 pF and the capacitance of the capacitor C2 is preferably about 3.0 pF, for example. The impedance of the input and output ports is preferably about 35Ω and the electrical characteristics have been normalized preferably using a value of about 35Ω, for example. The insertion loss preferably is about 0.73 dB and the isolation preferably is about 6.8 dB preferably in the range of about 1920 MHz to about 1980 MHz, for example. As a result of using the capacitor C2 as the second reactance element, the input and output impedances can be made high. If the capacitor C2 is not added, the impedance of the input and output ports is about 20Ω.

In addition, since the main line does not resonate, the main line can be reduced in length to be equal to or less than about ¼ of the wavelength, and in the first preferred embodiment the ferrite 10 preferably has a length and width of about 0.8 mm and 0.4 mm, respectively, a thickness of about 0.15 mm, a line width of about 0.2 mm and a saturation magnetization of about 100 mT, for example. Thus, combined with the fact that the ferrite 10 is much smaller than existing ferrites and the fact that single capacitors C1 and C2 are used as the reactance elements, a magnetic resonance type isolator that is compact and has low impedance can be obtained.

In particular, in the first preferred embodiment, the reason why the insertion loss characteristics and the isolation characteristics are excellent is that, for example, the opposing conductor 17, which extends in a direction perpendicular or substantially perpendicular to the main line, is arranged between the first and second ports P1 and P2 and as a result a high frequency magnetic field is confined to the ferrite 10 due to the opposing conductor 17 and leakage of the magnetic flux is small. The opposing conductor 17 is not necessarily required.

In addition, the ferrite 10 is vertically arranged on the mounting substrate 30 in state of being sandwiched between the pair of permanent magnets 20, which oppose the first and second main surfaces 11 and 12. Thus, the configuration of the circuit to which the capacitors C1 and C2 have been added can be simplified. A configuration in which the ferrite 10, which is sandwiched between the pair of permanent magnets 20, is vertically arranged on the mounting substrate 30 need not necessarily be adopted.

The magnetic resonance type isolator 1A, for example, can be built into a transmission circuit module of a mobile communication device. The mounting substrate 30 may be a printed wiring board for mounting a power amplifier in a transmission circuit module. In this case, the ferrite 10, which is provided with the connection conductor 15 and which is sandwiched between the permanent magnets 20, is supplied to the process of assembling the transmission module. This also applies to the other preferred embodiments described hereafter.

Second Preferred Embodiment

A magnetic resonance type isolator 1B according to a second preferred embodiment will be described hereafter with reference to FIGS. 6 and 7A to 7D.

The magnetic resonance type isolator 1B according to the second preferred embodiment preferably has the same configuration as that of the first preferred embodiment except that an inductor L1 is preferably used as the second reactance element.

The operational advantages of the second preferred embodiment are basically the same as those of the first preferred embodiment. The input return loss, isolation, insertion loss and output return loss of the magnetic resonance type isolator 1B according to the second preferred embodiment are illustrated in FIGS. 7A, 7B, 7C and 7D, respectively. The inductance of the inductor L1 preferably is about 5.1 nH and the capacitance of the capacitor C1 preferably is about 3.5 pF, for example. The impedance of the input and output ports preferably is about 10Ω and the electrical characteristics have been normalized preferably using a value of about 10Ω, for example. The insertion loss preferably is about 0.59 dB and the isolation preferably is about 8.4 dB preferably in the range of about 1920 MHz to about 1980 MHz, for example. The size and the like of the ferrite 10 are preferably the same as those of the ferrite 10 of the first preferred embodiment. As a result of using the inductor L1 as the second reactance element, the input and output impedances can be made low.

Third Preferred Embodiment

A magnetic resonance type isolator 1C according to a third preferred embodiment will be described hereafter with reference to FIGS. 8 to 11D.

Figure 9:
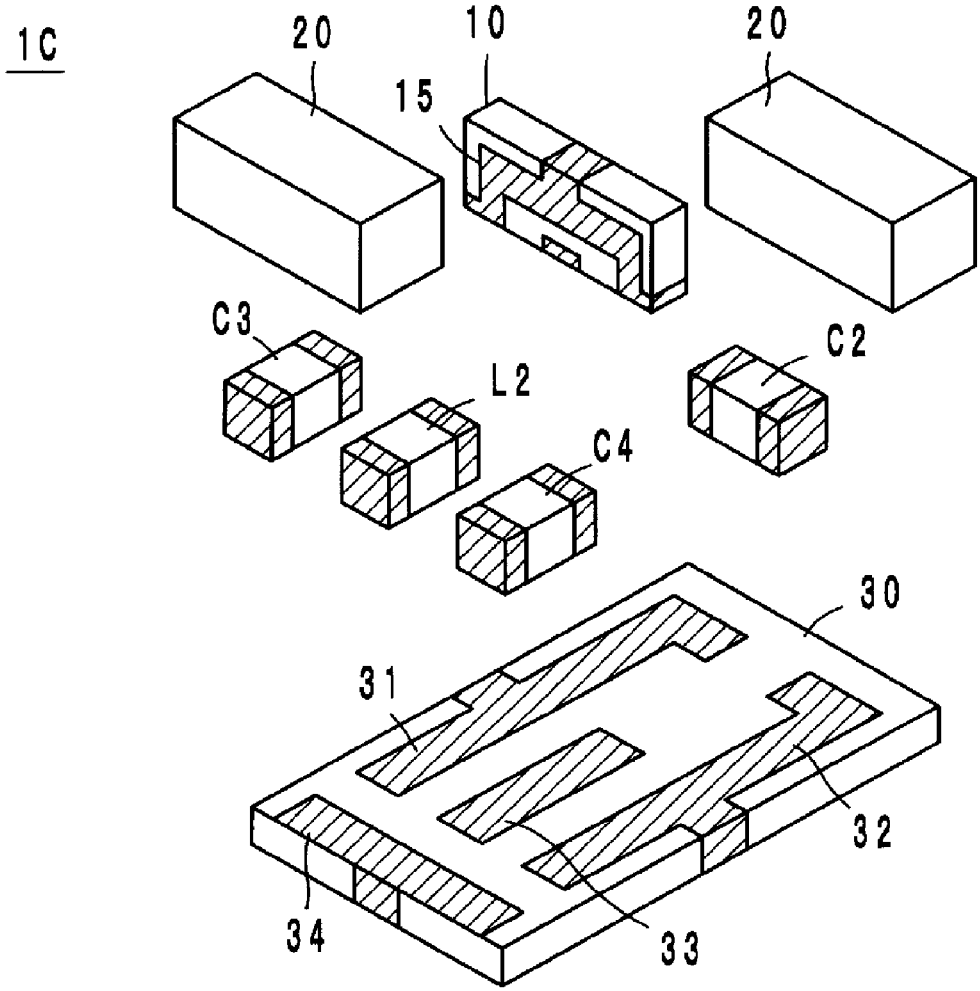
FIG. 9 is an exploded perspective view illustrating the magnetic resonance type isolator according to the third preferred embodiment of the present invention.
Figure 10:
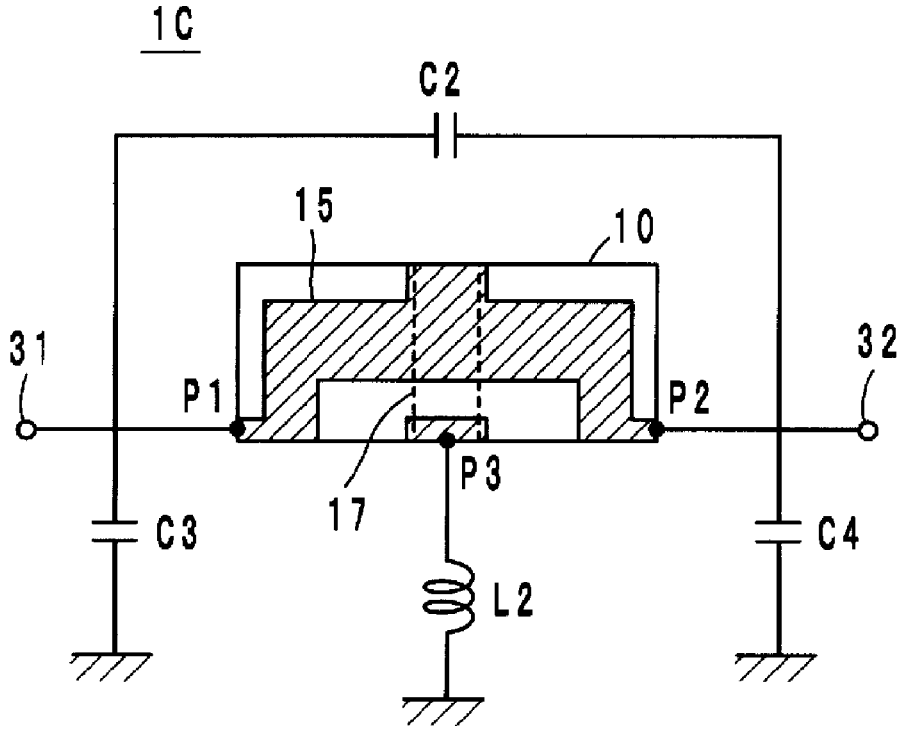
FIG. 10 is an equivalent circuit diagram of the magnetic resonance type isolator according to the third preferred embodiment of the present invention.
Figure 11A:
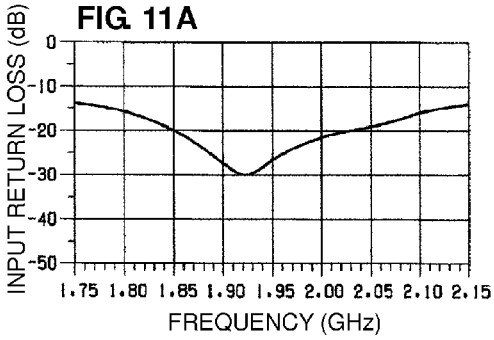
FIGS. 11A to 11D are graphs illustrating characteristics of the magnetic resonance type isolator according to the third preferred embodiment of the present invention.
Figure 11B:
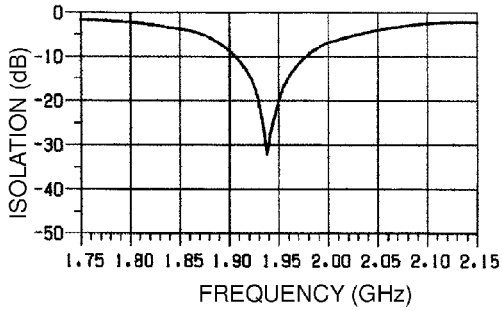
Figure 11C:
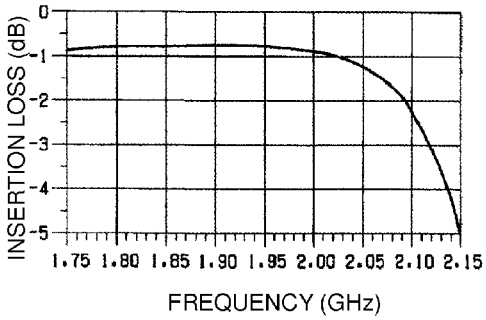
Figure 11D:
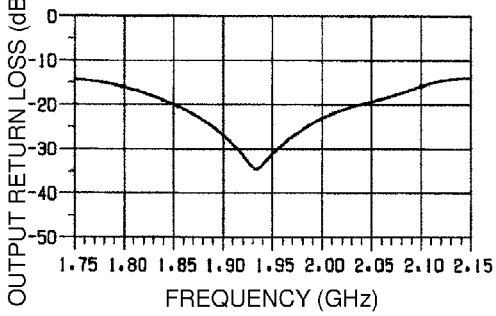

In the magnetic resonance type isolator 1C according to the third preferred embodiment, as illustrated in the equivalent circuit of FIG. 10, an inductor L2 is preferably used as the first reactance element, the capacitor C2 is preferably used as the second reactance element, and capacitors C3 and C4, which are connected to the ground, are respectively connected to the input terminal electrode 31 (first port P1) and the output terminal electrode 32 (second port P2). As illustrated in FIG. 9, the input terminal electrode 31, the output terminal electrode 32, the relay terminal electrode 33 and the ground terminal electrode 34 are provided on the mounting substrate 30. The rest of the configuration is preferably the same as that of the first preferred embodiment.

One end of the main line (first port P1) is connected to the input terminal electrode 31 and is connected to the ground terminal electrode 34 through the capacitor C3. The other end of the main line (second port P2) is connected to the output terminal electrode 32 and is connected to the ground terminal electrode 34 through the capacitor C4. An end portion of the sub-line (third port P3) is connected to the ground terminal electrode 34 through the relay terminal electrode 33 and the inductor L2.

The operational advantages of the third preferred embodiment are basically the same as those of the first preferred embodiment. The input return loss, isolation, insertion loss and output return loss of the magnetic resonance type isolator 1C according to the third preferred embodiment are illustrated in FIGS. 11A, 11B, 11C and 11D, respectively. The inductance of the inductor L2 preferably is about 2.0 nH, the capacitance of the capacitor C2 preferably is about 5.0 pF and the capacitances of the capacitors C3 and C4 preferably are about 1.5 pF, for example. The impedance of the input and output ports preferably is about 50Ω and the electrical characteristics have been normalized preferably using a value of about 50Ω. The insertion loss preferably is about 0.81 dB and the isolation preferably is about 9.0 dB preferably in the range of about 1920 MHz to about 1980 MHz, for example. The size and the like of the ferrite 10 are preferably the same as those of the ferrite 10 of the first preferred embodiment. As a result of using the capacitor C2 as the second reactance element, the input and output impedances can be made high. In particular, in the third preferred embodiment, in the case where the inductor L2 is connected to the third port P3, the impedances of the first and second ports P1 and P2 have an inductive characteristic and therefore capacitances are necessary as matching elements at the first and second ports P1 and P2. This point is also true in the fourth and fifth preferred embodiments described hereafter.

Fourth Preferred Embodiment

A magnetic resonance type isolator 1D according to the fourth preferred embodiment will be described hereafter with reference to FIGS. 12 and 13A to 13D.

Figure 12:
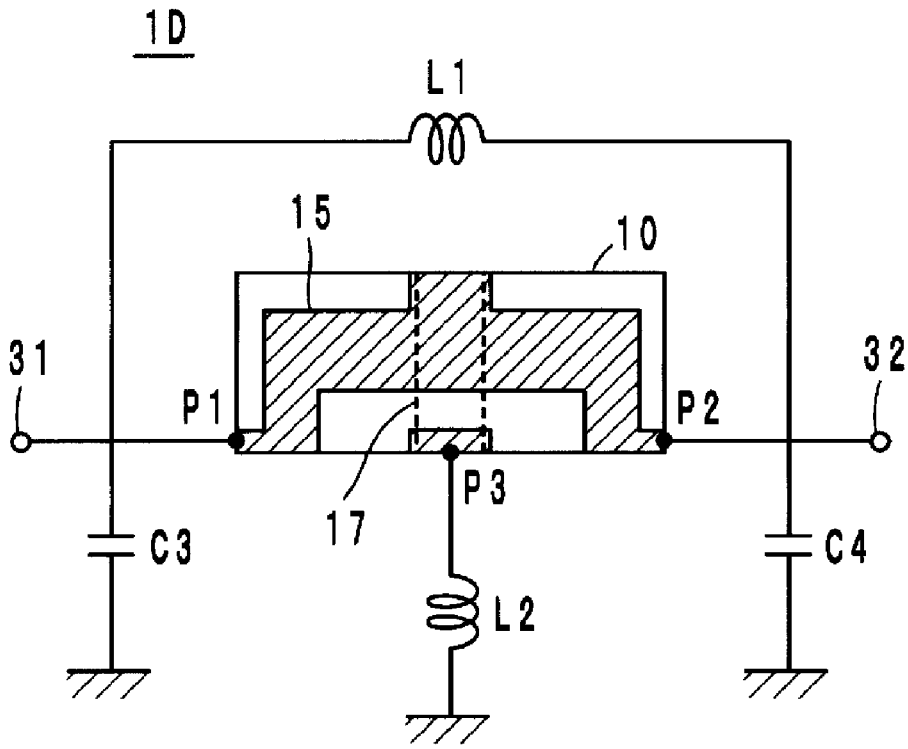
FIG. 12 is an equivalent circuit diagram of a magnetic resonance type isolator according to a fourth preferred embodiment of the present invention.
Figure 13A:
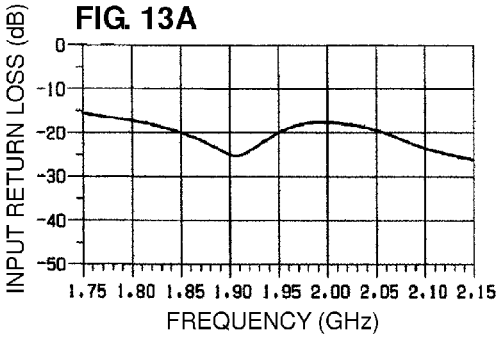
FIGS. 13A to 13D are graphs illustrating characteristics of the magnetic resonance type isolator according to the fourth preferred embodiment of the present invention.
Figure 13B:
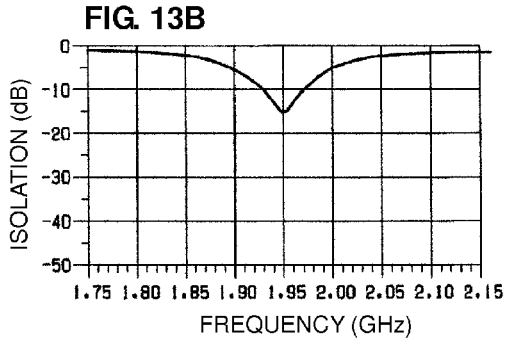
Figure 13C:
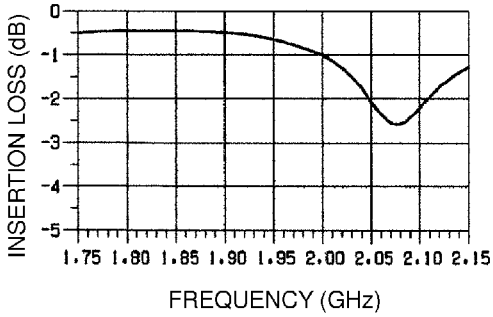
Figure 13D:
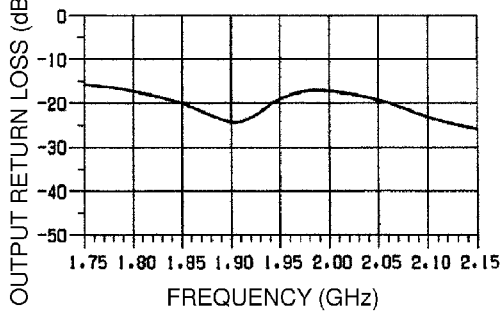
Figure 14:
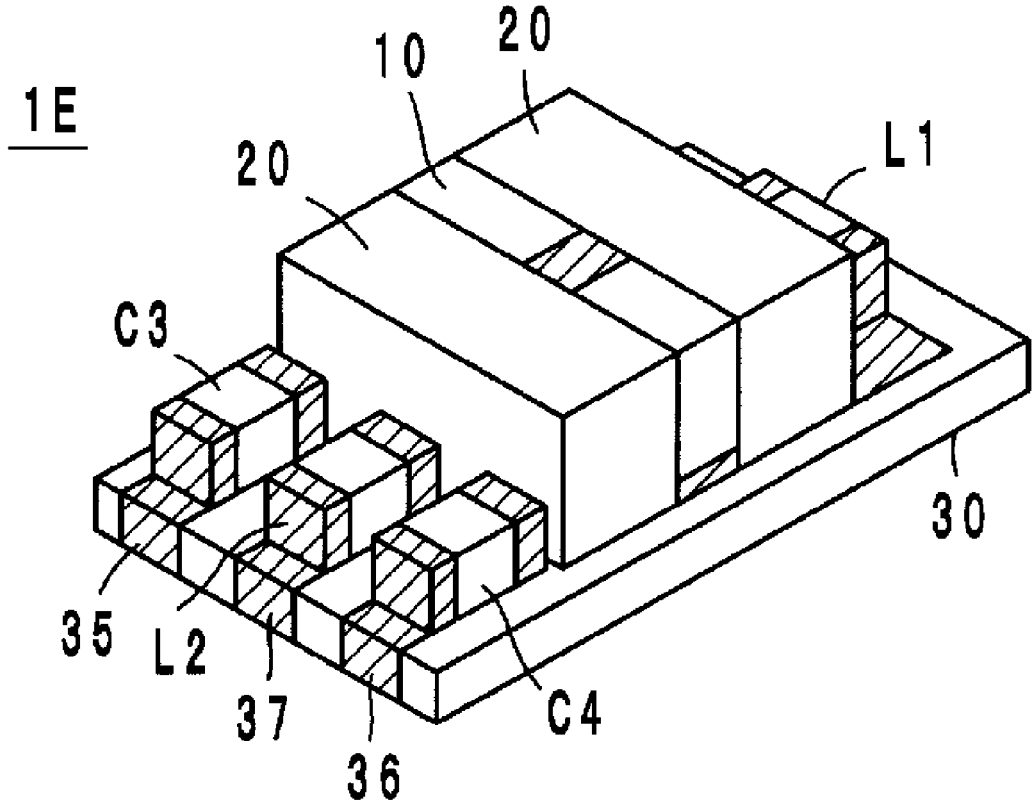
FIG. 14 is a perspective view illustrating a magnetic resonance type isolator according to a fifth preferred embodiment of the present invention.

The magnetic resonance type isolator 1D according to the fourth preferred embodiment preferably has the same configuration as that according to the third preferred embodiment (whose configuration is basically that of the first preferred embodiment) except that, as illustrated in the equivalent circuit of FIG. 12, the inductor L1 is preferably used as the second reactance element in contrast to the configuration of the third preferred embodiment.

The operational advantages of the fourth preferred embodiment are basically the same as those of the first preferred embodiment. The input return loss, isolation, insertion loss and output return loss of the magnetic resonance type isolator 1D according to the fourth preferred embodiment are illustrated in FIGS. 13A, 13B, 13C and 13D, respectively. The inductance of the inductor L2 preferably is about 2.0 nH, the inductance of the inductor L1 preferably is about 5.1 nH and the capacitances of the capacitors C3 and C4 preferably are about 1.5 pF, for example. The impedance of the input and output ports preferably is about 25Ω and the electrical characteristics have been normalized preferably using a value of about 25Ω, for example. The insertion loss preferably is about 0.84 dB and the isolation preferably is about 7.9 dB preferably in the range of about 1920 MHz to about 1980 MHz, for example. The size and the like of the ferrite 10 are preferably the same as those of the ferrite 10 of the first preferred embodiment. As a result of using the inductor L1 as the second reactance element, the input and output impedances can be made low.

Fifth Preferred Embodiment

A magnetic resonance type isolator 1E according to the fifth preferred embodiment will be described hereafter with reference to FIGS. 14 to 17D.

Figure 15:
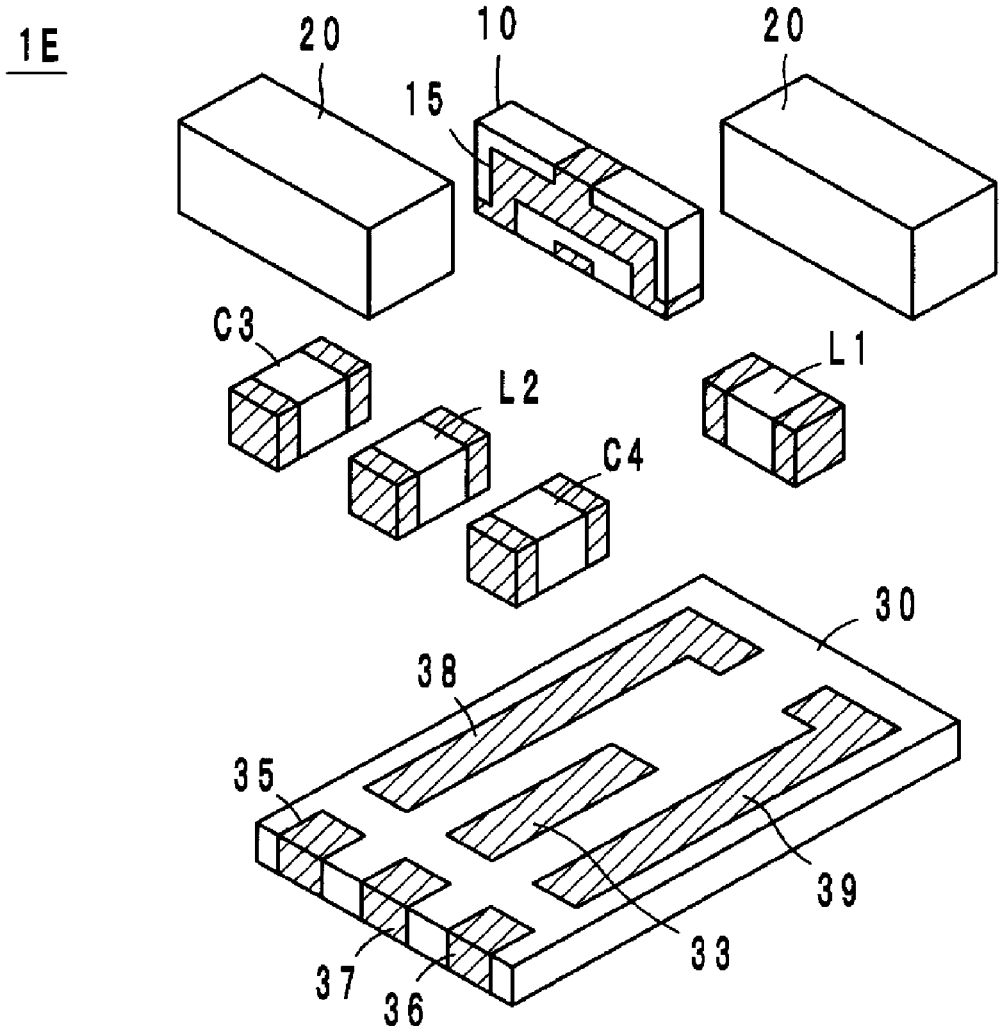
FIG. 15 is an exploded perspective view illustrating the magnetic resonance type isolator according to the fifth preferred embodiment of the present invention.
Figure 16:
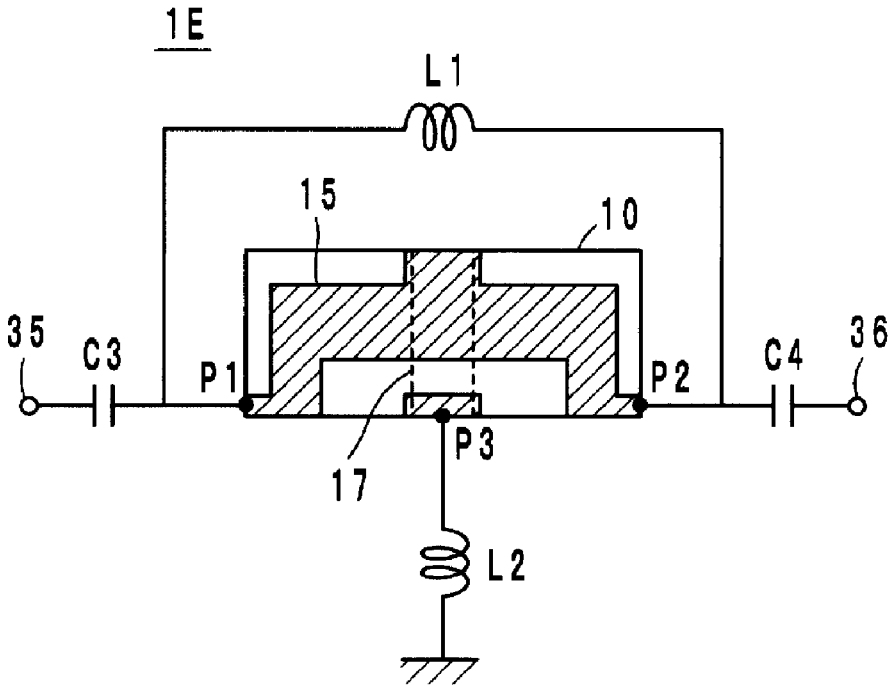
FIG. 16 is an equivalent circuit diagram of a magnetic resonance type isolator according to the fifth preferred embodiment of the present invention.
Figure 17A:
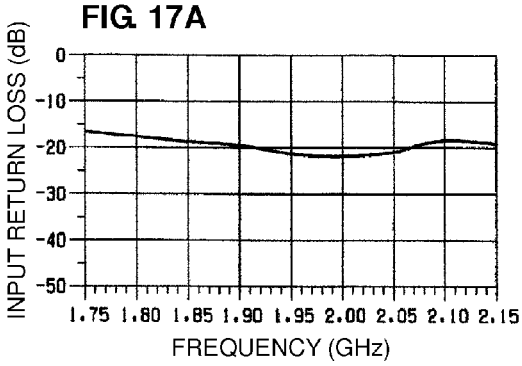
FIGS. 17A to 17D are graphs illustrating characteristics of the magnetic resonance type isolator according to the fifth preferred embodiment of the present invention.
Figure 17B:
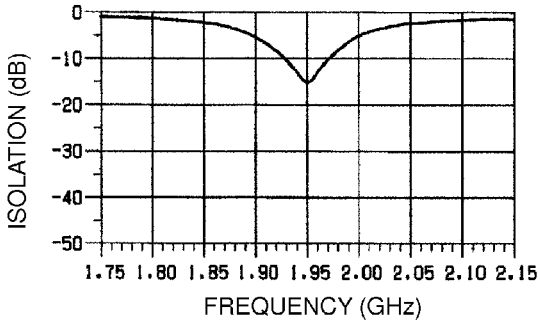
Figure 17C:
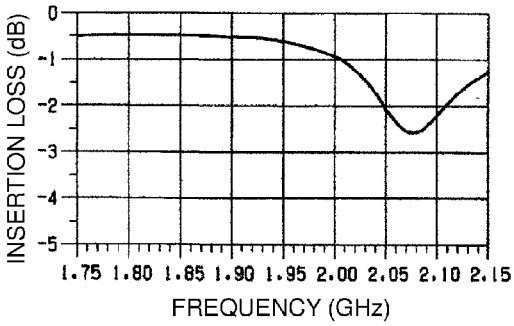
Figure 17D:
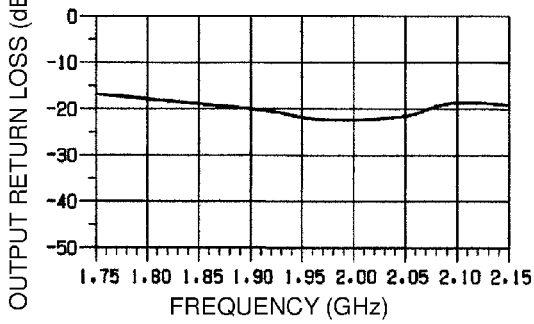

In the magnetic resonance type isolator 1E according to the fifth preferred embodiment, as illustrated in the equivalent circuit of FIG. 16, the inductor L2 is preferably used as the first reactance element, the inductor L1 is preferably used as the second reactance element, and the capacitor C3 is connected in series between the first port P1 and an input terminal electrode 35 and the capacitor C4 is connected in series between the second port P2 and an output terminal electrode 36. As illustrated in FIG. 15, the input terminal electrode 35, an output terminal electrode 36, the ground terminal electrode 37 and relay terminal electrodes 33, 38 and 39 are provided on the mounting substrate 30. The rest of the configuration preferably is the same as that of the first preferred embodiment.

One end of the main line (first port P1) is connected to the input terminal electrode 35 though the relay terminal electrode 38 and the capacitor C3 and the other end of the main line (second port P2) is connected to the output terminal electrode 36 through the relay terminal electrode 39 and the capacitor C4. An end portion of the sub-line (third port P3) is connected to the ground terminal electrode 37 through the relay terminal electrode 33 and the inductor L2.

The operational advantages of the fifth preferred embodiment are basically the same as those of the first preferred embodiment. The input return loss, isolation, insertion loss and output return loss of the magnetic resonance type isolator 1E according to the fifth preferred embodiment are illustrated in FIGS. 17A, 17B, 17C and 17D, respectively. The inductance of the inductor L2 preferably is about 2.0 nH, the inductance of the inductor L1 preferably is about 5.1 nH and the capacitances of the capacitors C3 and C4 preferably are about 8.0 pF, for example. The impedance of the input and output ports preferably is about 15Ω and the electrical characteristics have been normalized preferably using a value of about 15Ω, for example. The insertion loss preferably is about 0.78 dB and the isolation preferably is about 7.9 dB preferably in the range of about 1920 MHz to about 1980 MHz, for example. The size and the like of the ferrite 10 are preferably the same as those of the ferrite 10 of the first preferred embodiment. As a result of connecting the capacitors C3 and C4 in series with the first and second ports P1 and P2 respectively, the input and output impedances can be made low.

Other Preferred Embodiments

Magnetic resonance type isolators according to the present invention are not limited to the above-described preferred embodiments and can be modified within the scope of the present invention.

For example, the angle of the intersection between the main line and the sub-line in the connection conductor may be somewhat larger than or smaller than 90°. Furthermore, the size, shape, structure and the like of the mounting substrate may be appropriately chosen.

As described above, various preferred embodiments of the present invention are useful for magnetic resonance type isolators, for example, and are particularly excellent in that size reduction and adjustment of input and output impedances can be achieved.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A magnetic resonance type isolator comprising:

a ferrite;

a connection conductor that is arranged on the ferrite and includes a first port, a second port and a third port; and a permanent magnet that applies a direct current magnetic field to the ferrite; wherein a main line arranged between the first port and the second port of the connection conductor does not resonate, an end portion of a sub-line that branches off from the main line serves as the third port, a first reactance element is connected to the third port and the first reactance element is connected to the ground; and a second reactance element is connected between the first port and the second port.

2. The magnetic resonance type isolator according to claim 1, wherein an impedance matching element is connected to each of the first and second ports.

3. The magnetic resonance type isolator according to claim 1, wherein the first reactance element is an inductance element.

4. The magnetic resonance type isolator according to claim 1, wherein the first reactance element is a capacitance element.

5. The magnetic resonance type isolator according to claim 1, wherein the first reactance element is an inductance element, and a capacitance element connected to the ground is connected between the first port and an input port, and a capacitance element connected to the ground is connected between the second port and an output port.

6. The magnetic resonance type isolator according to claim 1, wherein the first reactance element is an inductance element, and a capacitance element connected to the ground is connected in series between the first port and an input port, and a capacitance element connected to the ground is connected in series between the second port and an output port.

7. The magnetic resonance type isolator according to claim 1, wherein the second reactance element is a capacitance element.

8. The magnetic resonance type isolator according to claim 1, wherein the second reactance element is an inductance element.

9. A magnetic resonance type isolator comprising:

a ferrite including a first main surface and a second main surface that oppose each other;

a connection conductor that is arranged on the first main surface of the ferrite and includes a first port, a second port and a third port; and a permanent magnet that applies a direct current magnetic field to the ferrite; wherein a main line arranged between the first port and the second port of the connection conductor does not resonate, a sub-line that branches off from the main line serves as an opposing conductor that extends in a direction perpendicular or substantially perpendicular to the main line onto the second main surface, an end portion of the opposing conductor serves as the third port, a first reactance element is connected to the third port and the first reactance element is connected to the ground; and a second reactance element is connected between the first port and the second port.

10. A magnetic resonance type isolator comprising:

a ferrite including a first main surface and a second main surface that oppose each other;

a connection conductor that is arranged on the first main surface of the ferrite and includes a first port, a second port and a third port;

a permanent magnet that applies a direct current magnetic field to the ferrite; and a mounting substrate; wherein a main line arranged between the first port and the second port of the connection conductor does not resonate, an end portion of a sub-line that branches off from the main line serves as the third port, a first reactance element is connected to the third port and the first reactance element is connected to the ground;

a second reactance element is connected between the first port and the second port; and the ferrite is sandwiched between a pair of permanent magnets, which respectively oppose the first and second main surfaces of the ferrite, and the ferrite is mounted on the mounting substrate such that the first and second main surfaces thereof are perpendicular or substantially perpendicular to a surface of the mounting substrate.

11. The magnetic resonance type isolator according to claim 10, wherein the sub-line serves as an opposing conductor, which extends in a direction perpendicular or substantially perpendicular to the main line onto the second main surface, and an end portion of the opposing conductor serves as the third port.

* * * * *